US008310165B2

(12) United States Patent
Yao

(10) Patent No.: US 8,310,165 B2
(45) Date of Patent: Nov. 13, 2012

(54) HIGH-VOLTAGE LED DRIVE SCHEME WITH PARTIAL POWER REGULATION

(75) Inventor: Kaiwei Yao, Santa Clara, CA (US)

(73) Assignee: Monolithic Power Systems, Inc., San Jose, CA (US)

( * ) Notice: Subject to any disclaimer, the term of this patent is extended or adjusted under 35 U.S.C. 154(b) by 342 days.

(21) Appl. No.: 12/817,484

(22) Filed: Jun. 17, 2010

(65) Prior Publication Data

US 2010/0320936 A1 Dec. 23, 2010

Related U.S. Application Data

(60) Provisional application No. 61/218,737, filed on Jun. 19, 2009.

(51) Int. Cl.
*H05B 37/00* (2006.01)

(52) U.S. Cl. ..... 315/192; 315/224; 315/307

(58) Field of Classification Search ..... 315/291, 315/307, 308, 185 R, 192, 193, 224
See application file for complete search history.

(56) References Cited

U.S. PATENT DOCUMENTS

| | | | | |
|---|---|---|---|---|
| 7,800,315 | B2 * | 9/2010 | Shteynberg et al. | 315/291 |
| 8,008,864 | B2 * | 8/2011 | Nguyen et al. | 315/122 |
| 8,134,310 | B2 * | 3/2012 | Wacknov et al. | 315/318 |
| 2009/0189548 | A1 * | 7/2009 | Hoffman et al. | 315/307 |

* cited by examiner

*Primary Examiner* — David H Vu
(74) *Attorney, Agent, or Firm* — Perkins Coie LLP

(57) ABSTRACT

A high-voltage LED drive scheme with multi-stage power regulation. The multi-stage power regulation applies two components of voltage to drive the LED strings. This scheme achieves high efficiency, small size and low cost.

15 Claims, 13 Drawing Sheets

Non-Isolated

HIGH-VOLTAGE LED DRIVE SCHEME WITH PARTIAL POWER REGULATION

CROSS-REFERENCE TO RELATED APPLICATION(S)

This application claims priority to and the benefit of U.S. Provisional Application No. 61/218,737, entitled A HIGH-VOLTAGE LED DRIVE SCHEME WITH PARTIAL POWER REGULATION filed Jun. 19, 2009, which is incorporated herein by reference in its entirety.

TECHNICAL FIELD

This invention relates generally to LED systems, and more particularly, to systems with a high-voltage LED drive scheme.

BACKGROUND

LED had become widely used in lighting applications because of its high brightness, efficiency, and long life. For television and other large panel applications, hundreds of LEDs are required. Driving the LEDs efficiently is a challenge. In a large panel application, due to improvement in light scattering technology, LEDs are typically placed around the edge of a panel and still achieve acceptable light distribution. Current designs have multiple LEDs arranged in series to form a string. Multiple strings (perhaps 4-6) are used for backlighting a single television panel. Each LED string is typically driven with a high voltage (on the order of several hundred volts). For example, a string consisting of 150 in series may require 525 volts.

FIG. 1 illustrates a prior art solution for providing a high-voltage to drive LED strings. An isolated DC-DC converter is used. The term isolated refers to the fact that the input and outputs of the converter are isolated by an electrical barrier, typically a transformer. The input is V_BUS, which is normally from a rectified AC line voltage or is the output of a PFC (power factor correction) circuit. An output VCC, which is a low voltage bus, is provided to power the control circuits. Note that the low voltage bus Vc is typically very small, i.e., less than 5 volts. Vc is only intended to power the controller circuit. Another output Vs1 is provided to power the LED strings. A boost converter (comprised of S1, D1, L1, Ci1 and Co1) is applied to drive one string of LEDs. A MOSFET SD1 is in series with the LED string to achieve fast PWM dimming. A resistor Rs1 is in series with the LED string to sense the LED current during the PWM dimming on period. Multiple boost converters are applied for multiple LED strings. Thus, each $block_{1\text{-}N}$ has a boost converter.

There are some disadvantages with the drive scheme of FIG. 1. The boost converter must handle high voltage. As a result, the breakdown voltages of the switch S1 and diode D1 need to be higher than the LED string voltage. For example, the transistors and diodes should be able to withstand 600 volts or more. In addition, the high voltage diode D1 has a serious reverse recovery issue. This limits the LED driver efficiency. Also, the switching frequency cannot be set high, in order to reduce the size of the certain components (such as L1, Ci1 and Co1). Furthermore, the required LED power is processed with two stages from V_BUS, which lowers efficiency.

DETAILED DESCRIPTION

In the description that follows, the scope of the term "an embodiment" is not to be limited as to mean more than one embodiment, but rather, the scope may include one embodiment, more than one embodiment, or perhaps all embodiments.

Figure 2A:
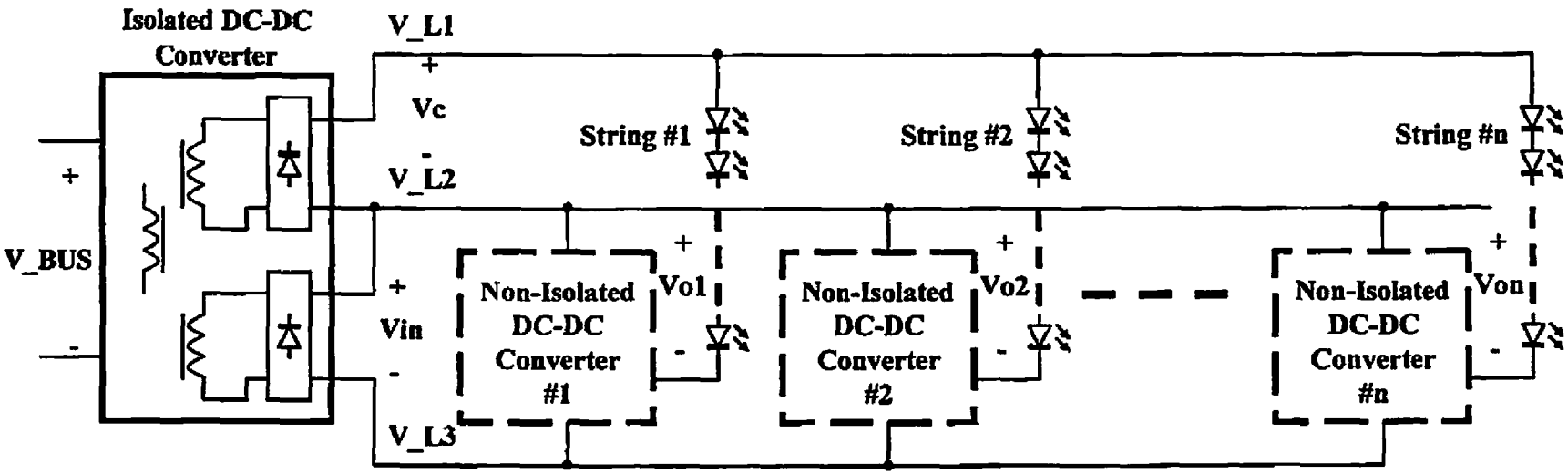
FIG. 2A shows a high voltage LED drive scheme with one input in accordance with a disclosed embodiment.
Figure 2B:
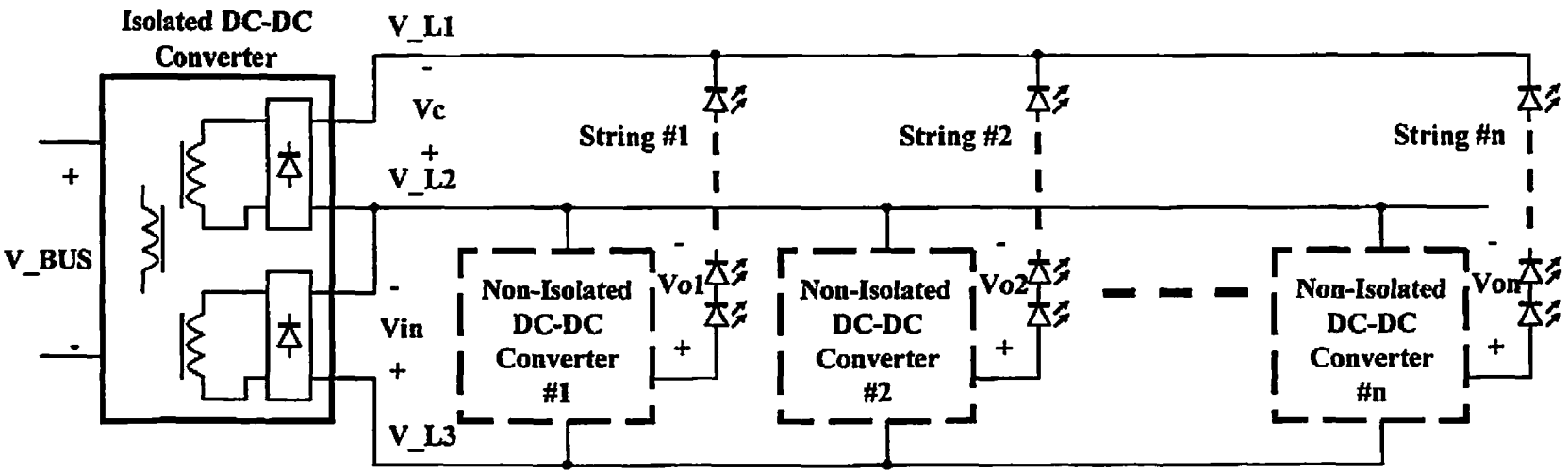
FIG. 2B shows another high voltage LED drive scheme with one input in accordance with another disclosed embodiment.

FIG. 2A and FIG. 2B illustrate high voltage LED drive schemes with two different topologies. An isolated DC-DC converter is provided, whose input is V_BUS which is normally from a rectified AC line voltage or is the output of a power factor correction (PFC) circuit. In one embodiment, the isolated DC-DC converter delivers three different voltage levels: V_L1, V_L2 and V_L3, which can be a positive, negative or zero value. In FIG. 2A, Vin=V_L2−V_L3, and Vin is a common input voltage for all non-isolated DC-DC converters. Vin can be a positive or negative value. Each non-isolated DC-DC converter regulates a negative DC voltage (−Vox), which is referred to the voltage level V_L2. Here "x" represents the corresponding LED driver number, such as 1 through n.

FIG. 2B illustrates another embodiment of a drive scheme with different voltage polarity and reversed LED string connection. For both connections, each LED string is driven by two signals, Vc and Vox, wherein Vc is the difference between V_L1 and V_L2, which is a common voltage used for driving all of the LED strings. Vox is regulated by the corresponding non-isolated DC-DC converter. The non-isolated DC-DC converter can be any type of step-up, step-down or step-up-and-down converter, such as buck, boost, buck-boost, cuk, sepic and zeta, etc.

Figure 1:
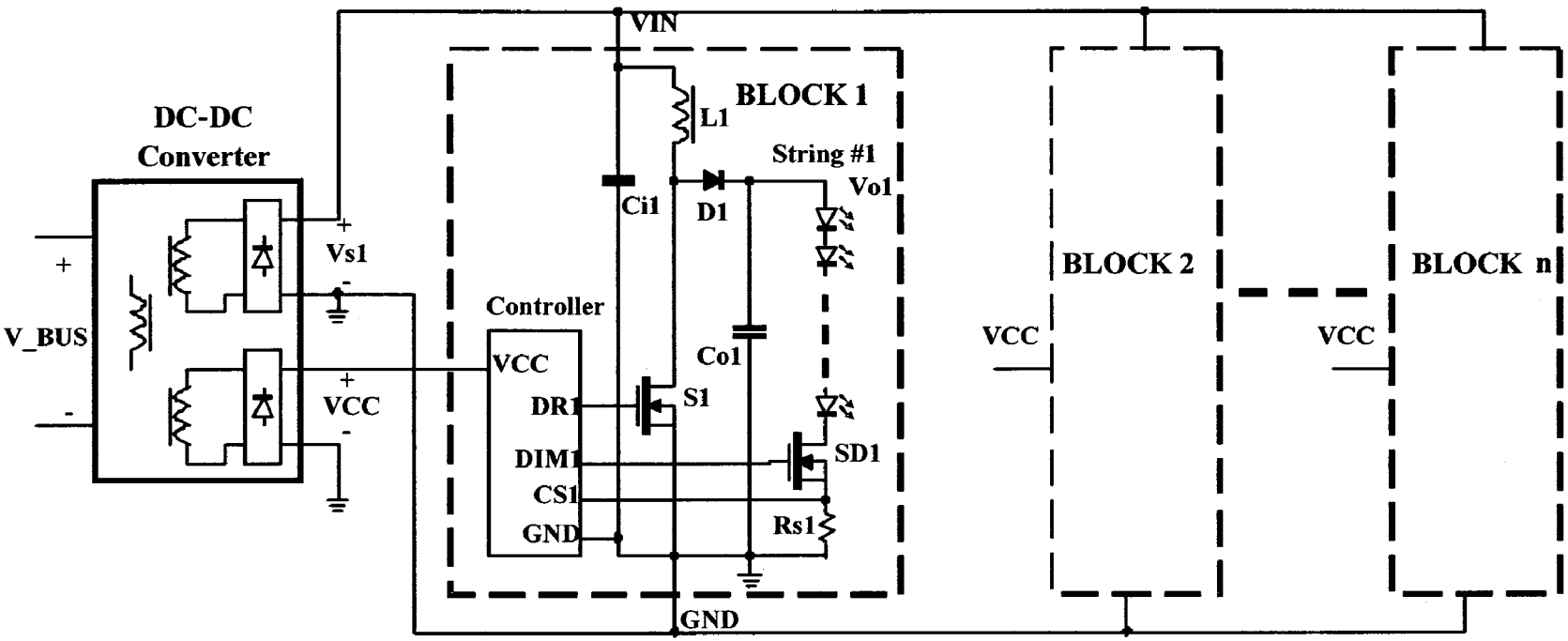
FIG. 1 (Prior Art)
FIG. 1 shows a prior art solution for a high voltage LED drive.

Note that the fast pulse width modulation (PWM) dimming switch and the current sensing resistor are not shown in FIG. 2A and FIG. 2B. However, they can be connected in series with the LED string as in FIG. 1 (SD1 and Rs1).

Figure 3:
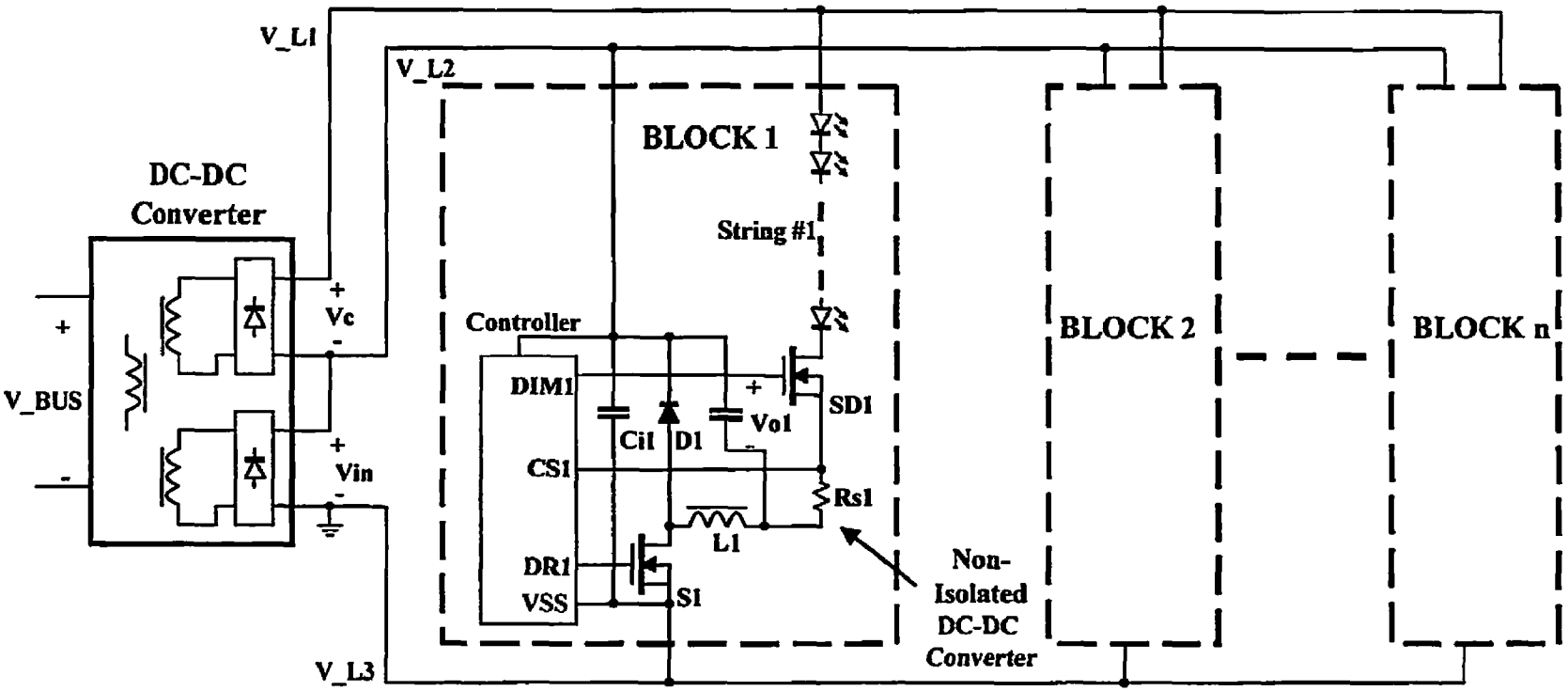
FIG. 3 shows an embodiment of the drive scheme of FIG. 2A using buck converters.

FIG. 3 illustrates an embodiment of the drive scheme of FIG. 2A with buck converters, i.e., the non-isolated DC-DC converters are buck converters. In this embodiment, the voltage stress on power devices is Vin, when V_L1=Vc+Vin, V_L2=Vin, and V_L3=0.

When buck switch S1 is turned on, Vin is supplied to the output of the buck converter via an output capacitor Co1, an inductor L1, and the buck switch S1. When the buck switch S1 is turned off, the output capacitor Co1, the inductor L1, and a diode D1 form a current loop. The output Vox of the buck converter is regulated by controlling the duty cycle of the buck switch S1.

When the fast PWM dimming switch SD1 is turned on, the current flowing through the current sense resistor Rs1 is the current flowing through the LED string. The LED string current is controlled by controlling the current flowing through the current sense resistor Rs1. Dimming is realized by controlling the duty cycle of the fast PWM dimming switch SD1.

Figure 4:
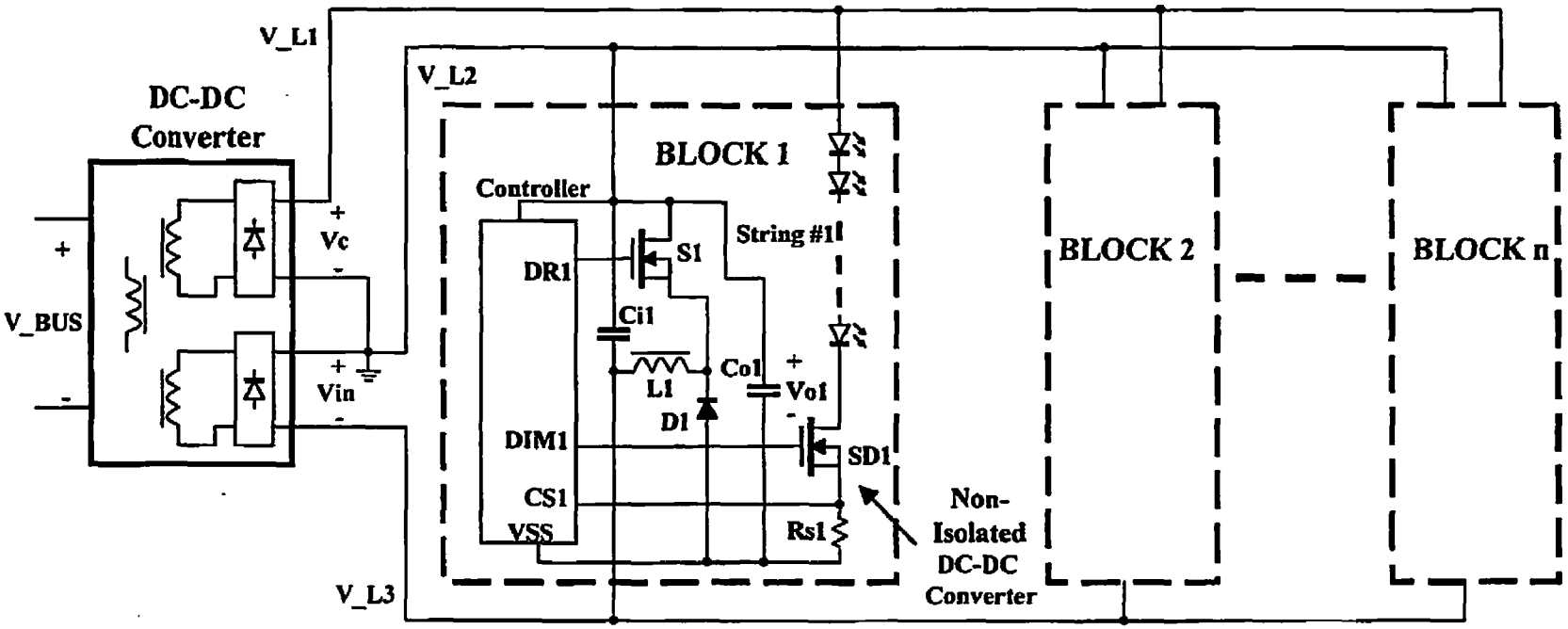
FIG. 4 shows another embodiment of the drive scheme of FIG. 2A using boost converters.

FIG. 4 illustrates an embodiment of the drive scheme of FIG. 2A with boost converters, i.e., the non-isolated DC-DC converter is a boost converter. In this embodiment, the voltage stress on power devices is Vox, when V_L1=Vc, V_L2=0, and V_L3=−Vin. Similar to FIG. 3, the output Vox of the converter is regulated by controlling the duty cycle of the boost switch S1. The LED string current is controlled by controlling the current flowing through the current sense resistor Rs1; and dimming is realized by controlling the duty cycle of the fast PWM dimming switch SD1.

Figure 5:
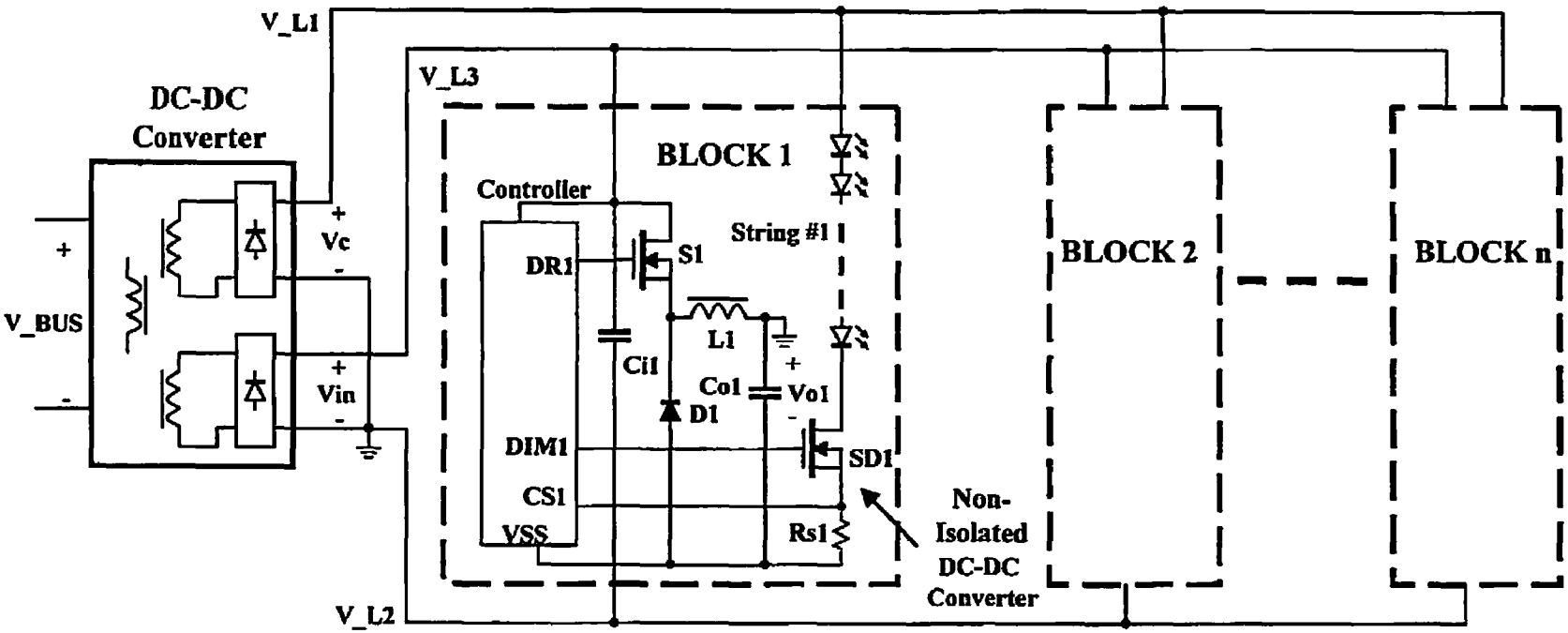
FIG. 5 shows yet another embodiment of the drive scheme of FIG. 2A using buck-boost converters.

FIG. 5 illustrates an embodiment of the drive scheme of FIG. 2A with buck-boost converters, i.e., the non-isolated DC-DC converter is a buck-boost converter. In this embodiment, the voltage stress on power devices is Vin+Vox, when V_L1=Vc, V_L2=0, and V_L3=Vin.

Figure 6:
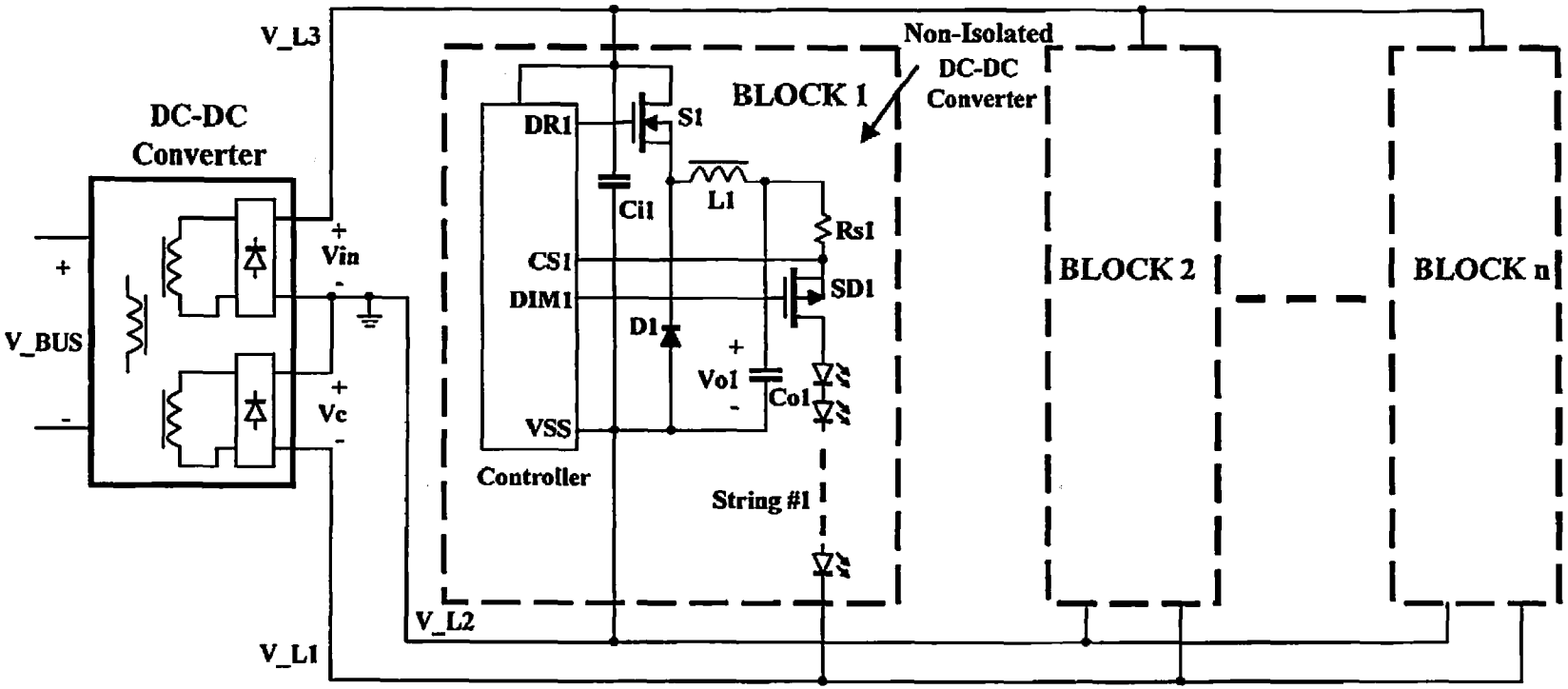
FIG. 6 shows an embodiment of the drive scheme of FIG. 2B using buck converters.

FIG. 6 illustrates an embodiment of the drive scheme of FIG. 2B with buck converters, i.e., the non-isolated DC-DC converter is a buck converter. In this embodiment, the voltage stress on power devices is Vin, when V_L1=−Vc, V_L2=0, and V_L3=Vin.

Figure 7:
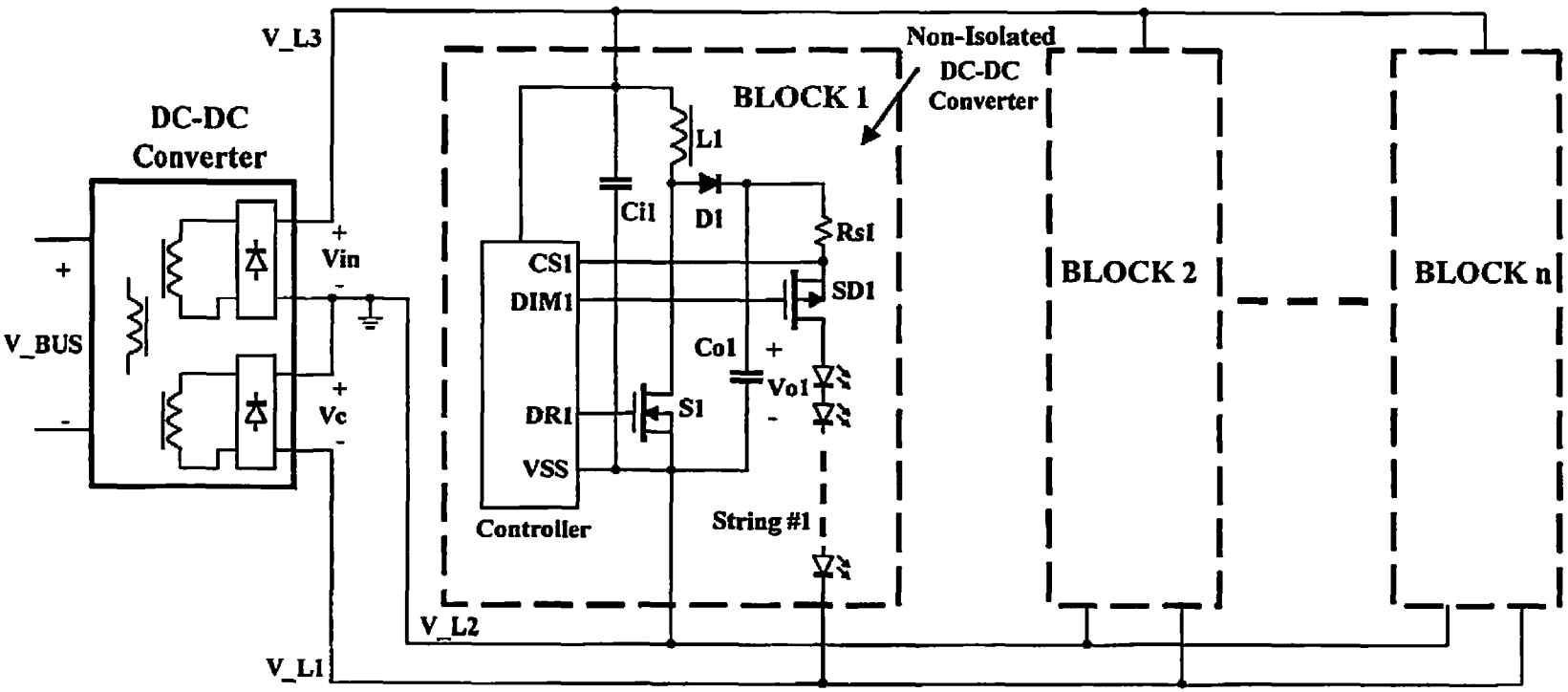
FIG. 7 shows another embodiment of the drive scheme of FIG. 2B using boost converters.

FIG. 7 illustrates an embodiment of the drive scheme of FIG. 2B with boost converters, i.e., the non-isolated DC-DC converter is a boost converter. In this embodiment, the voltage stress on power devices is Vox, when V_L1=−Vc, V_L2=0, and V_L3=Vin.

Figure 8:
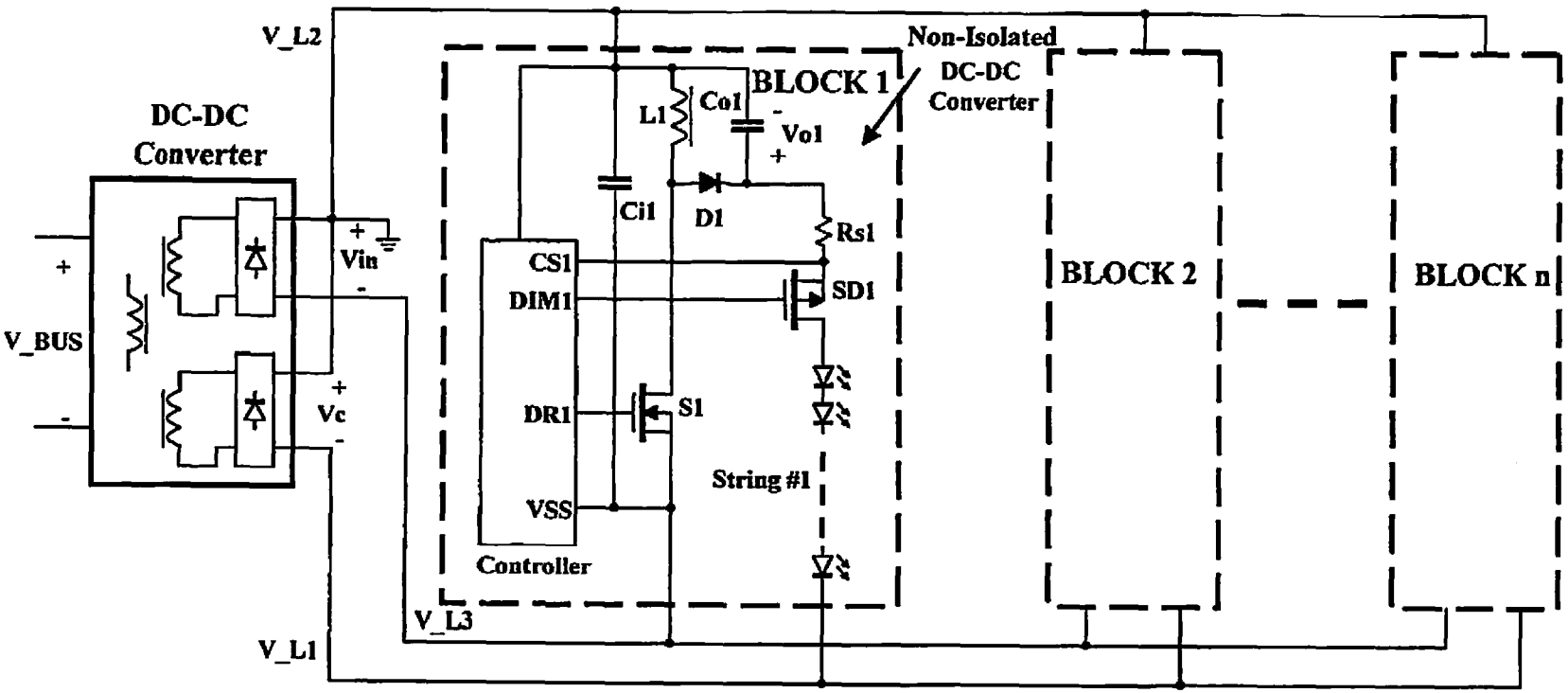
FIG. 8 shows yet another embodiment of the drive scheme of FIG. 2B using buck-boost converters.

FIG. 8 illustrates an embodiment of the drive scheme of FIG. 2B with buck-boost converters, i.e., the non-isolated DC-DC converter is a buck-boost converter. In this embodiment, the voltage stress on power devices is Vin+Vox, when V_L1=−Vc, V_L2=0, and V_L3=−Vin.

Some observations about the drive schemes disclosed:

1. Because the LED drive voltage is Vc+Vox, Vc can be the major part of the drive voltage. The energy is processed in only one stage from V_Bus. In addition, the isolated DC-DC converter is normally designed with soft switching technology, which significantly improves the LED drive efficiency.

2. Because the LED drive voltage is Vc+Vox, the non-isolated converter needs to regulate Vox only. As a result, only a portion of the required power for the LED drive is processed in two stages from V_Bus. Accordingly, the size of the components is much smaller.

3. The non-isolated DC-DC converter has much lower voltage stress. Indeed, because of the multi-stage driver disclosed herein, unlike the prior art, the switches and diodes of the non-isolated DC-DC converters need not handle the high voltages across the LED string. In one example, the switches and diodes may be designed to handle less than Vox+Vc. The switches can be integrated into an IC. The diodes can be Schottky diodes with no reverse recovery. These significantly improve the efficiency.

4. The non-isolated DC-DC converters can run at higher switching frequency, which further reduces the size of the passive components.

Figure 9:
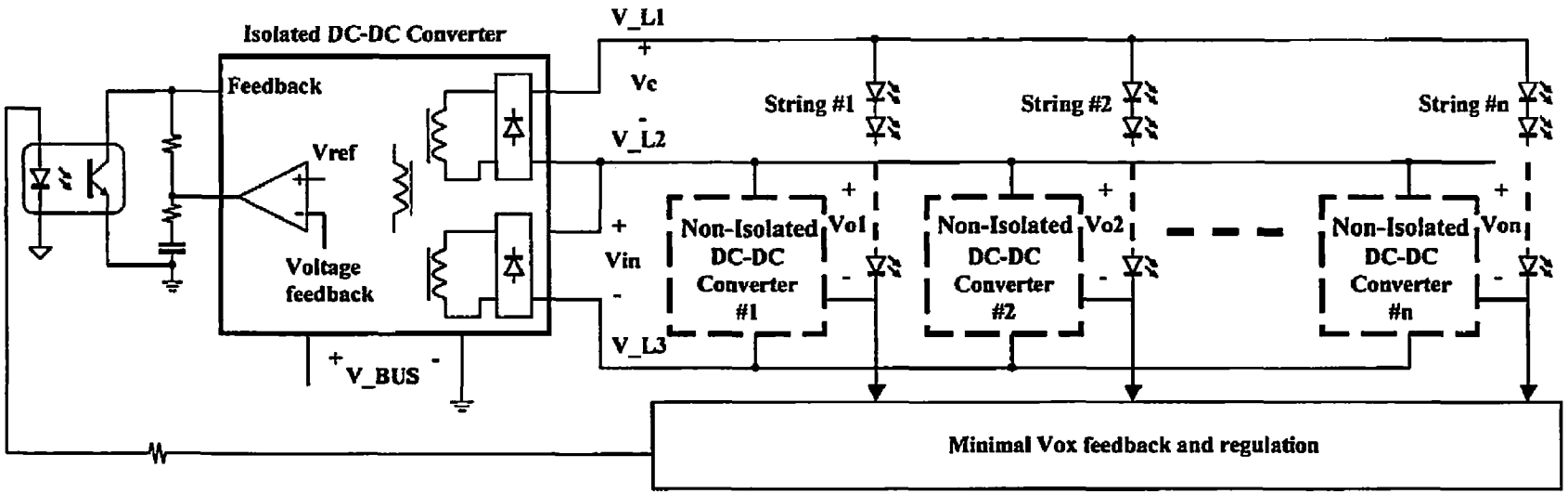
FIG. 9 is yet another disclosed embodiment of a high voltage LED drive scheme.

Furthermore, the proposed LED drive schemes in FIG. 2A and FIG. 2B can be improved as shown in FIG. 9. In FIG. 2A and FIG. 2B, the LED drive voltage is Vc+Vox. Vc is unrelated to Vox. In FIG. 9, the minimal output voltage of Vox is fed back to the pre-stage isolated DC-DC converter. The pre-stage isolated DC-DC converter regulates the Vc value accordingly so that the minimal output voltage of Vox is kept in a certain value. If all LED strings are turned off, the isolated DC-DC converter will regulate the output voltage according to its own reference. This scheme offers more advantages: minimizing the power processed by the non-isolated DC-DC converter, fully taking advantages of Vc to drive the LED strings. Only voltage mismatch among different strings needs to be taken care of in non-isolated DC-DC converters so that the voltage stress can be further reduced. Finally, such a scheme offers better efficiency.

Figure 10:
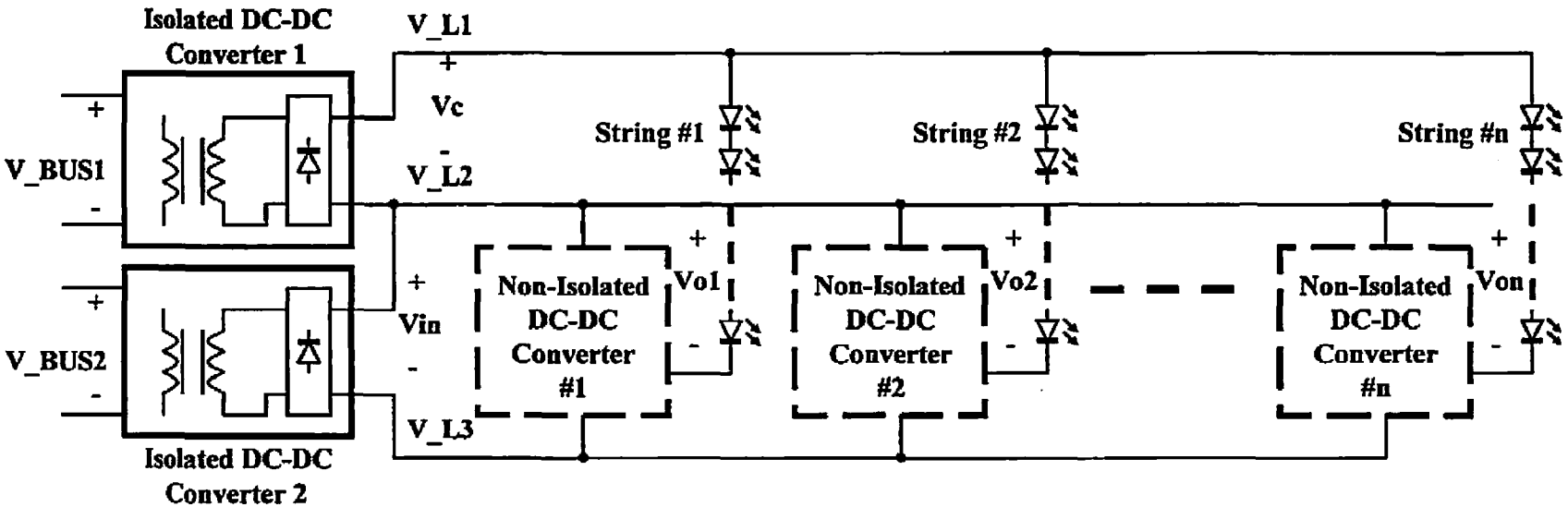
FIG. 10 is yet another disclosed embodiment of a high voltage LED drive scheme.
Figure 11:
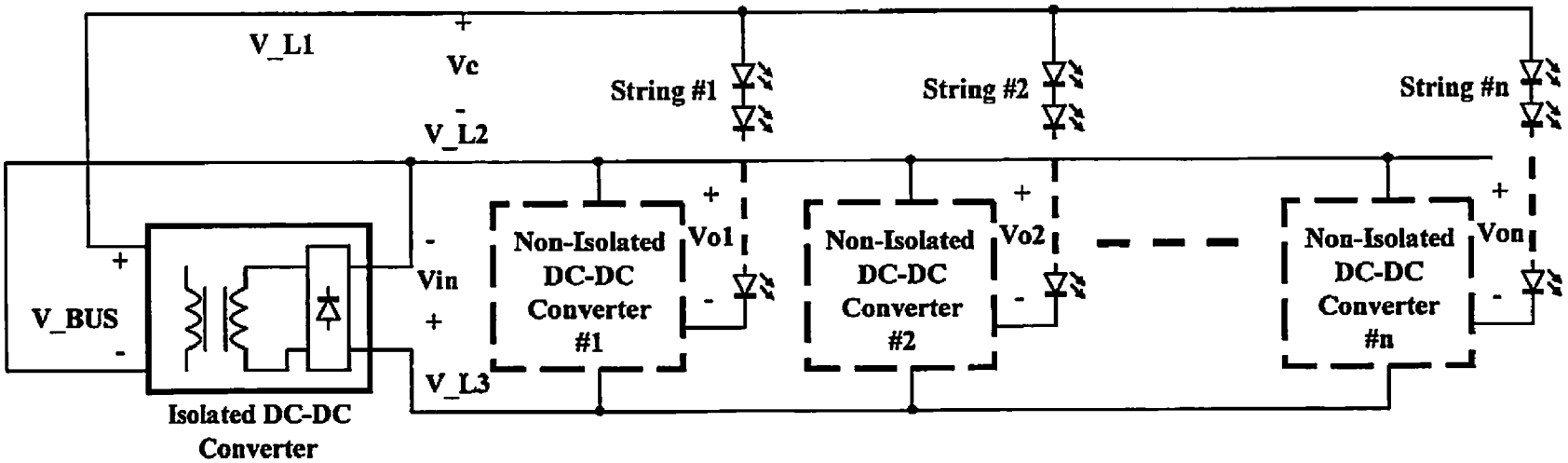
FIG. 11 is yet another disclosed embodiment of a high voltage LED drive scheme.
Figure 12:
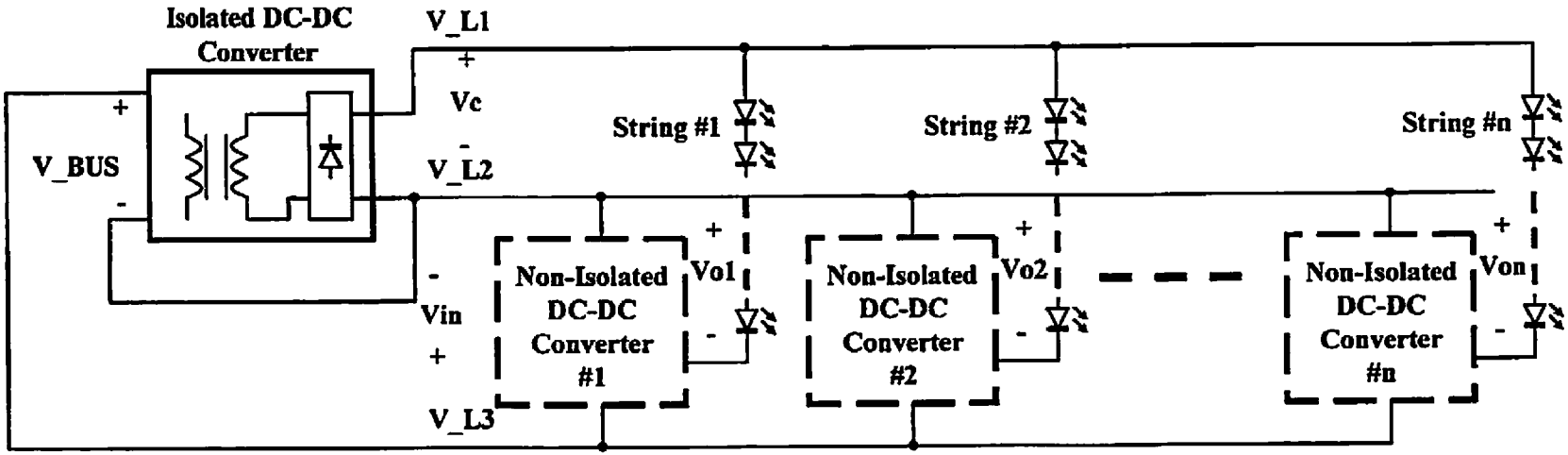
FIG. 12 is yet another disclosed embodiment of a high voltage LED drive scheme.

Further, the proposed LED drive scheme is not limited with one input V_BUS, as shown in FIG. 2A and FIG. 2B. There may be two inputs with two isolated DC-DC converters, as shown in FIG. 10 based on the structure of FIG. 2A. If there is no isolation requirement, V_BUS can be Vc directly, as shown in FIG. 11, be based on structure as in FIG. 2A. Alternatively, V_BUS can be Vin directly, as shown in FIG. 12 based on structure as in FIG. 2A. All the isolated DC-DC converters in FIGS. 10-12 can be non-isolated DC-DC converters too.

Furthermore, the related modifications in FIGS. 9-12 could be applied based on structure as in FIG. 2B as well.

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above teachings. It is therefore intended that the scope of the invention be limited not by this detailed description, but rather by the claims appended hereto.

This written description uses examples to disclose the invention, including the best mode, and also to enable a person skilled in the art to make and use the invention. The patentable scope of the invention may include other examples that occur to those skilled in the art.

I claim:

1. A multi-stage driver for an LED string comprising:

a first DC-DC converter that receives an input signal V_BUS and provides at least a first converted signal Vin and a second converted signal Vc in response to the input signal V_BUS;

a second DC-DC converter that receives the first converted signal Vin, and based thereupon, provides a regulated signal Vox, and wherein the LED string is driven by both the second converted signal Vc and the regulated signal Vox.

2. The driver of claim 1, wherein the first DC-DC converter comprises an isolated DC-DC converter.

3. The driver of claim 1, wherein the second converter is either a buck converter, a boost converter, or a buck-boost converter.

4. The driver of claim 1, wherein the second converter includes switches and diodes that are designed to handle less than the sum of the regulated signal Vox and the second converted signal Vc.

5. The driver of claim 1, wherein the second DC-DC converter further comprises:

a fast PWM dimming switch coupled in series with the LED string; and a current sense resistor coupled in series with the fast PWM dimming switch.

6. The driver of claim 1, wherein the input signal is a rectified signal from a rectified AC line voltage or an output signal from a power factor correction (PFC) circuit.

7. The driver of claim 1 wherein the regulated signal Vox is feedback to the first DC-DC converter, and further wherein the first DC-DC converter regulates the second converted signal Vc to be such that the regulated signal Vox is minimized.

8. A multi-stage LED driver system, comprising:

a first DC-DC converter for providing at least a first converted signal Vin and a second converted signal Vc in response to at least one input signal V_BUS;

a plurality of second DC-DC converters, each of the second DC-DC converters operable to provide a regulated signal Vox in response to the first converted signal, and a plurality of LED strings each coupled to the first DC-DC converter to receive the second converted signal Vc, and coupled to one of the second DC-DC converters to receive the regulated signal Vox, wherein said plurality of LED strings are driven by the combination of Vc and Vox.

9. The system of claim 8, wherein the first converter comprises an isolated DC-DC converter.

10. The system of claim 8, wherein the second DC-DC converters are buck, boost, buck-boost, or some combination of the foregoing converters.

11. The system of claim 8, wherein the second DC-DC converters includes switches and diodes that are designed to handle less than the sum of the regulated signal Vox and the second converted signal Vc.

12. The system of claim 8, wherein the system further comprise:

a fast PWM dimming switch set, the fast PWM dimming switch set comprises N switches, wherein each switch is coupled in series with one LED string;

a current sense resistor set, the current sense resistor set comprises N resistors, wherein each resistor is coupled in series with one switch.

13. The system of claim 8, wherein the input signal is a rectified signal from a rectified AC line voltage or an output signal from a PFC circuit.

14. The system of claim 8, further comprising a minimum value detector, for feeding back the minimum regulated signal provided by the second DC-DC converters to the first converter.

15. The system of claim 14, wherein the first DC-DC converter regulates the second signal Vc in response to the minimum regulated signal.

* * * * *